US008959886B2

(12) United States Patent
Lee et al.

(10) Patent No.: US 8,959,886 B2
(45) Date of Patent: Feb. 24, 2015

(54) MESH COOLED CONDUIT FOR CONVEYING COMBUSTION GASES

(75) Inventors: Ching-Pang Lee, Cincinnati, OH (US); Humberto A. Zuniga, Casselberry, FL (US); Jay A. Morrison, Oviedo, FL (US)

(73) Assignees: Siemens Energy, Inc., Orlando, FL (US); Mikro Systems, Inc., Charlottesville, VA (US)

( * ) Notice: Subject to any disclaimer, the term of this patent is extended or adjusted under 35 U.S.C. 154(b) by 1057 days.

(21) Appl. No.: 12/832,124

(22) Filed: Jul. 8, 2010

(65) Prior Publication Data

US 2012/0006518 A1 Jan. 12, 2012

(51) Int. Cl.

| | |
|---|---|
| ***F23R 3/06*** | (2006.01) |
| ***F23R 3/00*** | (2006.01) |
| ***F01D 9/02*** | (2006.01) |

(52) U.S. Cl.

CPC ..... *F23R 3/005* (2013.01); *F01D 9/023* (2013.01); *F23R 3/06* (2013.01); *F23R 2900/03042* (2013.01); *F23R 2900/03043* (2013.01); *F23R 2900/03044* (2013.01); *F23R 2900/03045* (2013.01)

USPC ..... 60/39.37; 60/754; 60/757; 60/752

(58) Field of Classification Search

CPC ..... F23R 2900/03042; F23R 2900/03043; F23R 2900/03044; F23R 2900/03045; F23R 3/005; F23R 3/06

USPC ..... 60/752, 755, 757, 758, 39.37, 754; 416/97 A

See application file for complete search history.

(56) References Cited

U.S. PATENT DOCUMENTS

| | | | | | |
|---|---|---|---|---|---|
| 2,919,549 | A | * | 1/1960 | Haworth et al. | 60/755 |
| 3,349,558 | A | | 10/1967 | Smith | |
| 4,312,186 | A | * | 1/1982 | Reider | 60/754 |
| 4,315,406 | A | * | 2/1982 | Bhangu et al. | 60/754 |
| 4,361,010 | A | | 11/1982 | Tanrikut et al. | |
| 4,446,693 | A | * | 5/1984 | Pidcock et al. | 60/757 |
| 4,642,993 | A | * | 2/1987 | Sweet | 60/758 |
| 4,719,748 | A | | 1/1988 | Davis, Jr. et al. | |
| 5,370,499 | A | | 12/1994 | Lee | |
| 5,415,000 | A | | 5/1995 | Mumford et al. | |
| 5,615,546 | A | * | 4/1997 | Althaus et al. | 60/752 |
| 5,690,472 | A | | 11/1997 | Lee | |
| 5,778,676 | A | * | 7/1998 | Joshi et al. | 60/746 |
| 6,209,325 | B1 | * | 4/2001 | Alkabie | 60/737 |
| 6,402,470 | B1 | * | 6/2002 | Kvasnak et al. | 416/97 R |
| 6,494,044 | B1 | | 12/2002 | Bland | |
| 6,530,225 | B1 | | 3/2003 | Hadder | |

(Continued)

*Primary Examiner* — Ted Kim

(57) ABSTRACT

A conduit through which hot combustion gases pass in a gas turbine engine. The conduit includes a wall structure having an inner surface, an outer surface, a region, an inlet, and an outlet. The inner surface defines an inner volume of the conduit. The region extends between the inner and outer surfaces and includes cooling fluid structure defining a plurality of cooling passageways. The inlet extends inwardly from the outer surface and provides fluid communication between the inlet and the passageways. The outlet extends from the passageways to the inner surface to provide fluid communication between the passageways and the inner volume. At least one first cooling passageway intersects with at least one second cooling passageway such that cooling fluid flowing through the first cooling passageway interacts with cooling fluid flowing through the second cooling passageway.

19 Claims, 3 Drawing Sheets

(56) References Cited

U.S. PATENT DOCUMENTS

| | | | | |
|---|---|---|---|---|
| 6,568,187 | B1 | 5/2003 | Jorgensen et al. | |
| 6,640,547 | B2 | 11/2003 | Leahy, Jr. | |
| 6,890,148 | B2 * | 5/2005 | Nordlund | 60/757 |
| 7,010,921 | B2 | 3/2006 | Intile et al. | |
| 7,182,576 | B2 | 2/2007 | Bunker et al. | |
| 7,186,084 | B2 | 3/2007 | Bunker et al. | |
| 7,310,938 | B2 | 12/2007 | Marcum et al. | |
| 7,712,314 | B1 * | 5/2010 | Barnes et al. | 60/755 |
| 7,886,517 | B2 * | 2/2011 | Chopra et al. | 60/754 |
| 8,307,657 | B2 * | 11/2012 | Chila | 60/754 |
| 2002/0066273 | A1 * | 6/2002 | Kitamura et al. | 60/752 |
| 2010/0071377 | A1 * | 3/2010 | Fox et al. | 60/752 |
| 2010/0083665 | A1 * | 4/2010 | Hoffmann | 60/752 |

* cited by examiner

MESH COOLED CONDUIT FOR CONVEYING COMBUSTION GASES

FIELD OF THE INVENTION

The present invention relates to gas turbine engines and, more particularly, to a mesh cooled conduit that conveys hot combustion gases.

BACKGROUND OF THE INVENTION

In turbine engines, compressed air discharged from a compressor section and fuel introduced from a source of fuel are mixed together and burned in a combustion section, creating combustion products defining hot combustion gases. The combustion gases are directed through a hot gas path in a turbine section, where they expand to provide rotation of a turbine rotor. The turbine rotor may be linked to an electric generator, wherein the rotation of the turbine rotor can be used to power the compressor section and produce electricity in the generator.

One or more conduits, e.g., liners, transition ducts, etc., are typically used for conveying the combustion gases from one or more combustor assemblies located in the combustion section to the turbine section. Due to the high temperature of the combustion gases, the conduits are typically cooled during operation of the engine to avoid overheating.

Prior art solutions for cooling the conduits include supplying a cooling fluid, such as air that is bled off from the compressor section, onto an outer surface of the conduit to provide direct convection cooling to the transition duct. An impingement member or impingement sleeve may be provided about the outer surface of the conduit, wherein the cooling fluid may flow through small holes formed in the impingement member before being introduced onto the outer surface of the conduit. Other prior art solutions inject a small amount of cooling fluid along an inner surface of the conduit to provide film cooling to the inner surface of the conduit.

SUMMARY OF THE INVENTION

In accordance with a first aspect of the present invention, a conduit is provided through which hot combustion gases pass in a gas turbine engine. The conduit comprises a wall structure having an inner surface, an outer surface, a region, an inlet, and an outlet. The inner surface defines an inner volume of the conduit. The region extends between the inner and outer surfaces and comprises cooling fluid structure defining a plurality of cooling passageways. The inlet extends inwardly from the outer surface to the passageways to allow cooling fluid to pass through the inlet and enter the passageways. The outlet extends from the passageways to the inner surface to allow cooling fluid to exit the passageways and enter the inner volume. At least one first cooling passageway intersects with at least one second cooling passageway such that cooling fluid flowing through the first cooling passageway interacts with cooling fluid flowing through the second cooling passageway.

The outlet may comprise at least one exit passage formed in the wall structure and extending at an angle such that the cooling fluid passing into the inner volume of the conduit through the at least one exit passage includes an axial component of a velocity vector in the same direction as the direction of flow of the hot combustion gases passing through the conduit.

The outlet may further comprise an exit manifold formed in the wall structure and in communication with the passageways in the region and the at least one exit passage.

The cooling fluid structure may define a mesh arrangement of cooling passageways, wherein each of two or more of the cooling passageways intersects with a plurality of other ones of the cooling passageways such that the cooling fluid flowing through each of the two or more cooling passageways interacts with cooling fluid flowing through the other ones of the cooling passageways, causing turbulent air flows and pressure drops in the passageways.

The inlet may be located axially upstream from the outlet such that the cooling fluid flowing through the cooling passageways flows axially downstream from the inlet to the outlet.

The inlet may be located axially downstream from the outlet such that the cooling fluid flowing through the cooling passageways flows axially upstream from the inlet to the outlet.

The inlet may comprise an annular groove formed in the wall structure, the annular groove in fluid communication with at least two of the cooling passageways defined by the cooling fluid structure.

The cooling fluid structure may comprise a plurality of diamond-shaped nodes.

The outlet may comprise an annular manifold formed in the wall structure, the annular manifold in fluid communication with each of the cooling passageways defined by the cooling fluid structure.

The outlet may further comprise a plurality of passages formed in the wall structure, each passage in fluid communication with the annular manifold.

In accordance with a second aspect of the present invention, a conduit is provided through which hot combustion gases pass in a gas turbine engine, the conduit comprises a wall structure having an inner surface, an outer surface, a region, an inlet, and an outlet. The inner surface defines an inner volume of the conduit. The region extends between the inner and outer surfaces and comprises cooling fluid structure defining a plurality of cooling passageways. The inlet extends inwardly from the outer surface to the passageways to allow cooling fluid to pass through the inlet and enter the passageways. The outlet extends from the passageways to the inner surface to allow cooling fluid to exit the passageways and enter the inner volume. The cooling fluid structure defines a mesh arrangement of cooling passageways, wherein each of two or more cooling passageways intersects with a plurality of other ones of the cooling passageways such that the cooling fluid flowing through each of the two or more cooling passageways interacts with cooling fluid flowing through the other ones of the cooling passageways.

In accordance with a third aspect of the present invention, a conduit is provided through which hot combustion gases pass in a gas turbine engine, the conduit comprises a wall structure having an inner surface, an outer surface, a region, an inlet, and an outlet. The inner surface defines an inner volume of the conduit. The region extends between the inner and outer surfaces and comprises cooling fluid structure defining a plurality of cooling passageways. The inlet extends inwardly from the outer surface to the passageways to allow cooling fluid to pass through the inlet and enter the passageways. The outlet extends from the passageways to the inner surface to allow cooling fluid to exit the passageways and enter the inner volume. The outlet comprises an exit manifold formed in the wall structure in communication with the passageways in the region and a plurality of passages formed in the wall structure, each passage in fluid communication with the exit manifold. At least one first cooling passageway intersects with at least one second cooling passageway such that cooling fluid flowing through the first cooling passageway interacts with cooling fluid flowing through the second cooling passageway.

The cooling fluid structure may comprise a plurality of diamond-shaped nodes and may define a mesh arrangement of first and second cooling passageways, wherein each first cooling passageway intersects with a plurality of second cooling passageways such that the cooling fluid flowing through each first cooling passageway interacts with cooling fluid flowing through the plurality of second cooling passageways, causing turbulent air flows and pressure drops in the passageways.

The conduit may be located between a combustion section and a turbine section in the gas turbine engine.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
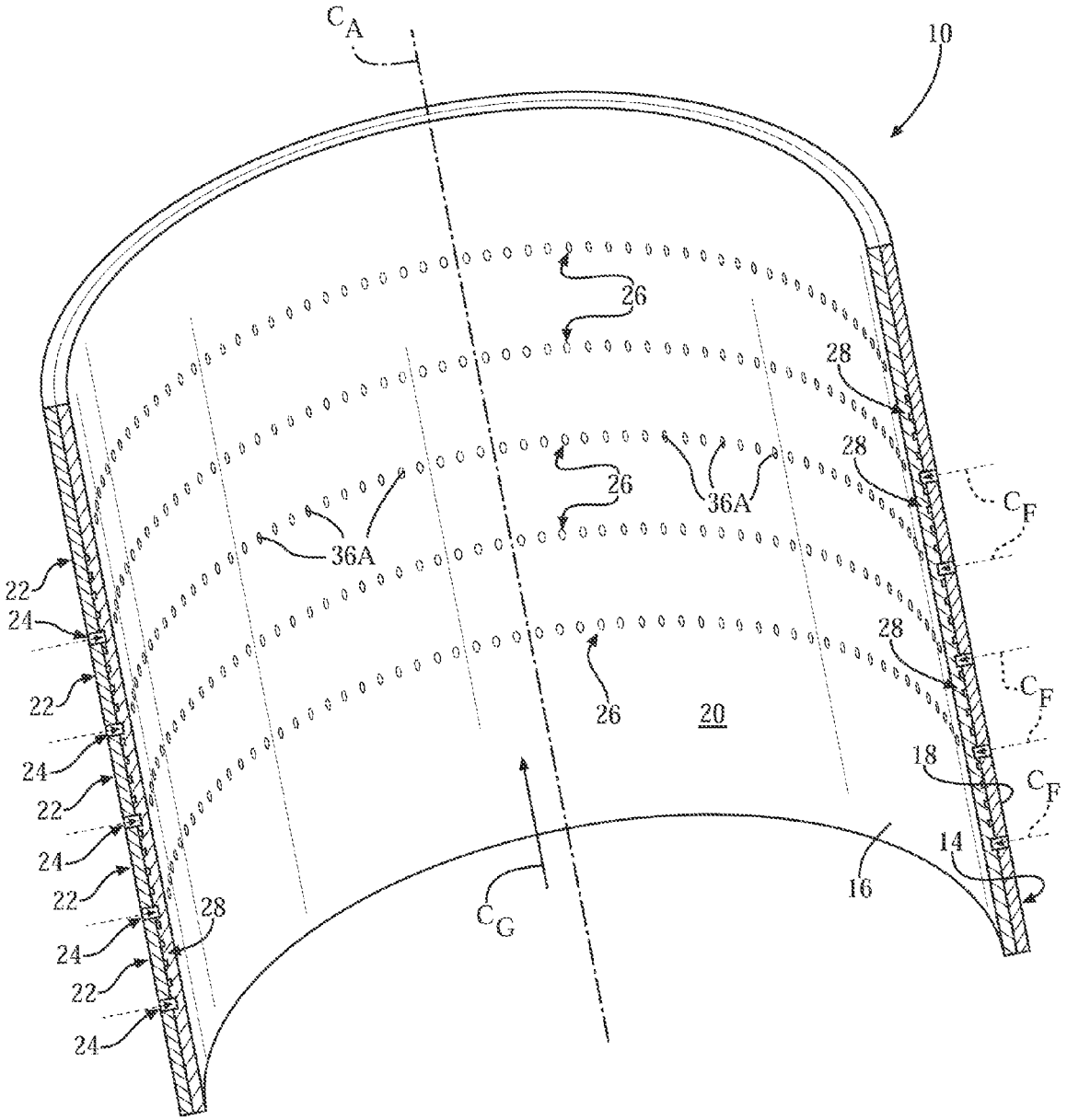
FIG. 1 is a sectional view of a portion of a conduit for use in a gas turbine engine according to an embodiment of the invention.
Figure 2:
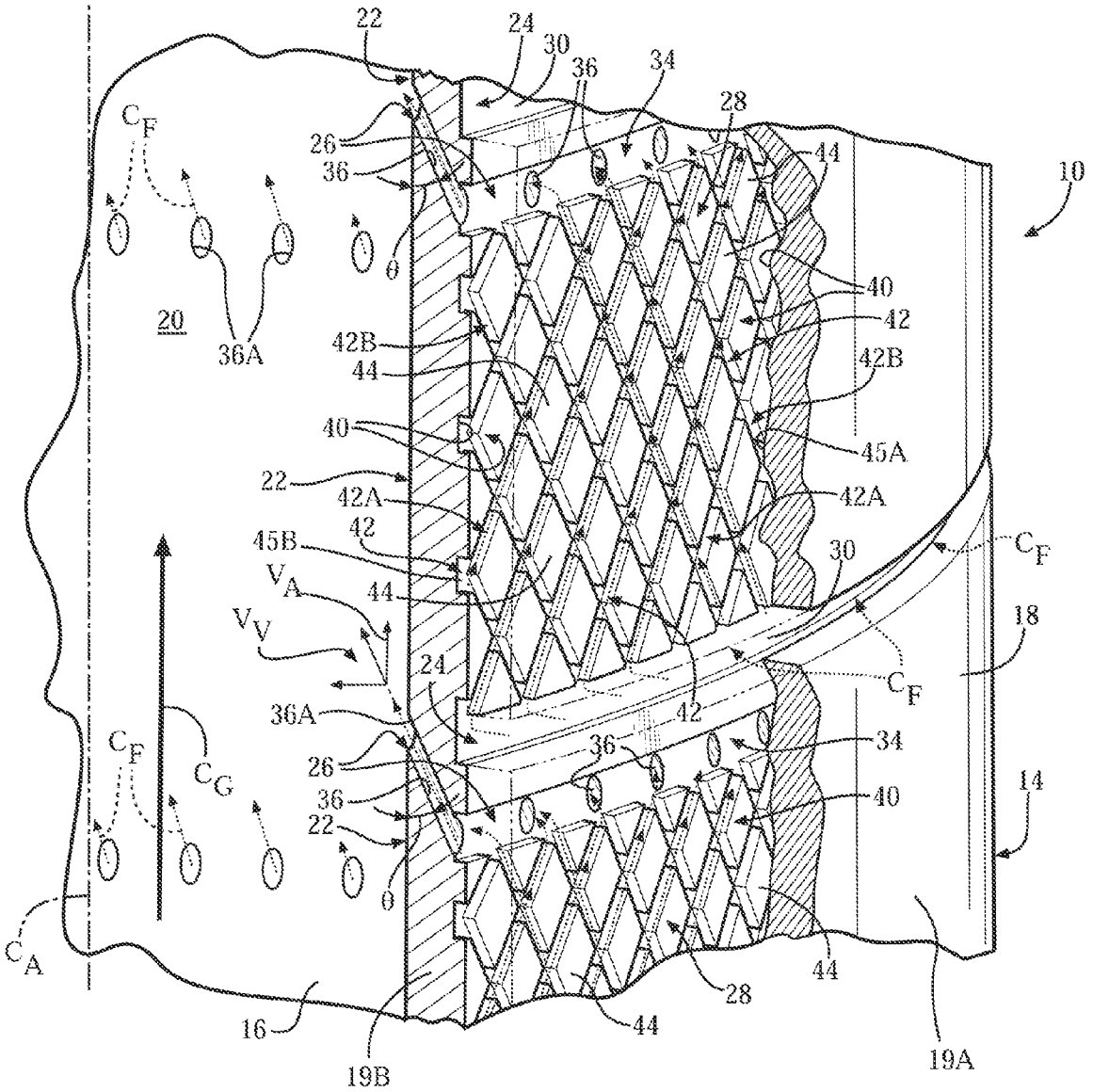
FIG. 2 is an enlarged view of a portion of the conduit illustrated in FIG. 1.

Referring to FIGS. 1 and 2, a conduit 10 is illustrated for use in a gas turbine engine (not shown). The conduit 10 may be, for example, a liner or transition duct that conveys hot combustion gases from a combustion section (not shown) of the engine toward a turbine section (not shown) of the engine, such as the liner or transition duct disclosed in U.S. Pat. No. 5,415,000, issued May 16, 1995, entitled "LOW NOx COMBUSTOR RETRO-FIT SYSTEM FOR GAS TURBINES," the entire disclose of which is hereby incorporated by reference herein. The conduit 10 may also be the duct structure disclosed in U.S. application Ser. No. 11/498,479, filed Aug. 3, 2006, entitled "AT LEAST ONE COMBUSTION APPARATUS AND DUCT STRUCTURE FOR A GAS TURBINE ENGINE," by Robert J. Bland, the entire disclose of which is hereby incorporated by reference herein.

The conduit 10 comprises a wall structure 14 having a central axis $C_A$ and having an inner surface 16 and an outer surface 18. The inner surface 16 defines an inner volume 20 of the conduit 10 through which the hot combustion gases pass, see FIGS. 1 and 2. The hot combustion gases are represented by the solid line-arrows $C_G$ in FIGS. 1 and 2.

The wall structure 14 may be formed from a high heat tolerant material capable of operation in the high temperature environment of the combustion section of the engine, such as, for example, a stainless steel alloy or an INCONEL alloy (INCONEL is a registered trademark of Special Metals Corporation), although any suitable high heat tolerant material may be used to form the wall structure 14. In the embodiment shown, the wall structure 14 comprises a generally cylindrical shape, although it is understood that the wall structure 14 could define other shapes, such as, for example, a rectangular shape. The wall structure 14 could also transition between multiple different shapes, such as, for example, from a generally cylindrical shape to a generally rectangular shape. It is noted that a portion of the wall structure 14 comprising the outer surface 18 has been removed in FIG. 2 to illustrate the portion of the wall structure 14 between the inner and outer surfaces 16 and 18, as will be discussed in detail herein.

The wall structure 14 comprises a plurality of sections 22, each section 22 comprising a cooling fluid inlet 24, a cooling fluid outlet 26, and a region 28 extending between the inner and outer surfaces 16 and 18 of the wall structure 14. The wall structure 14 may comprise a single, unitary structure including all of the sections 22 as shown in FIGS. 1 and 2, or may be formed from a plurality of wall structure portions that are joined together using any suitable method, such as, for example, by bolting or welding, wherein each piece includes one or more of the sections 22.

Referring to FIG. 2, one of the sections 22 of the wall structure 14 will now be described, it being understood that the remaining sections 22 may be substantially similar to the section 22 described.

The inlet 24 of the section 22 extends radially inwardly through an outer wall-like segment 19A, having an outer surface defining the outer surface 18 of the wall structure 14. The inlet 24 comprises an annular groove 30 that is in fluid communication with the region 28. The annular groove 30 in the embodiment shown extends radially inwardly to an inner wall-like segment 19B and about substantially the entire circumference of the inner segment 19B. However, it is understood that the inlet 24 could comprise other configurations, such as wherein the inlet 24 comprises a plurality of openings formed in the outer segment 19A of the wall structure 14, see, for example, FIG. 3, which will be discussed below. In the illustrated embodiment, the outer and inner segments 19A and 19B are integral with one another and define the wall structure 14. As will be discussed herein, cooling fluid, represented by the dotted line-arrows $C_F$ in FIGS. 1 and 2, enters the wall structure section 22 through the inlet 24, passes through the region 28, and flows out of the wall structure section 22 via the outlet 26. Additional details in connection with the flow of the cooling fluid $C_F$ through the wall structure section 22 will be discussed below.

The outlet 26 of the section 22 extends from the region 28 through the inner segment 19B to the inner surface 16 of the wall structure 14. In the embodiment shown, the outlet 26 comprises an annular exit manifold 34 formed within one or both of the outer and inner segments 19A and 19B of the wall structure section 22 and a plurality of exit passages 36 extending through the inner segment 19B. The exit manifold 34 is in fluid communication with the region 28 and receives the cooling fluid $C_F$ therefrom. The cooling fluid $C_F$ is distributed from the exit manifold 34 into the inner volume 20 of the conduit 10 via the exit passages 36. Preferably, the exit passages 36 extend through the inner segment 19B at an angle θ relative to the central axis $C_A$ of the wall structure 14 such that the cooling fluid $C_F$ passing into the inner volume 20 of the conduit 10 includes an axial component $V_A$ of a velocity vector $V_V$ in the same direction as the direction of flow of the hot combustion gases $C_G$ passing through the conduit 10, see FIG. 2. In the preferred embodiment, the angle θ may be about 20° to about 45° relative to the central axis $C_A$ of the wall structure 14. It is noted that outlets 36A of the exit passages 36 in the embodiment shown are all located in a common plane, as most clearly shown in FIG. 1.

In the embodiment shown, the inlet 24 of the section 22 is located axially upstream from the corresponding outlet 26 such that the cooling fluid $C_F$ flowing through the region 28 flows axially downstream from the inlet 24 to the outlet 26 in the same direction as the hot combustion gases $C_G$ flow through the conduit 10. However, it is contemplated that the inlet 24 may be located axially downstream from the corresponding outlet 26, see, for example, FIG. 3.

Referring to FIG. 2, the region 28 comprises cooling fluid structure 40 that is located between the inner and outer surfaces 16 and 18 of the wall structure 14. The cooling fluid structure 40 defines a plurality of cooling passageways 42 that extend through the region 28. The cooling passageways 42 are in fluid communication with the annular groove 30 and with the exit manifold 34 so as to convey the cooling fluid $C_F$ from the inlet 24 to the outlet 26 of the section 22. Specifically, the cooling fluid $C_F$ flows into the section 22 through the corresponding inlet 24, passes through the cooling passageways 42, and exits the wall structure section 22 through the corresponding outlet 26. The cooling fluid structure 40 may be formed, for example, from a ceramic core, although other suitable materials may be used.

Referring still to FIG. 2, the cooling passageways 42 comprise a series of first passageways 42A and a series of second passageways 42B. The first passageways 42A extend in a first direction and the second passageways 42B extend in a second direction that may mirror the first direction. For example, the first passageways 42A may extend in a first direction that is angled in the axial direction about 45° relative to the central axis $C_A$, although it is understood that the first direction could extend at other angles relative to the central axis $C_A$ depending on the particular configuration of the engine. The second passageways 42B may thus extend in a second direction that is angled in the axial direction about −45° relative to the central axis $C_A$. It is noted that the second direction need not mirror the first direction.

With the first passageways 42A extending in the first direction and the second passageways 42B extending in the second direction, the cooling fluid structure 40 comprises a plurality of diamond-shaped nodes 44 as well as radially inner surface sections 45A of the outer segment 19A and radially outer surface sections 45B of the inner segment 19B that define a mesh arrangement of the first and second cooling passageways 42A and 42B. Thus, each of the cooling passageways 42, i.e., the first and second cooling passageways 42A and 42B, intersects with a plurality of other ones of the cooling passageways 42. That is, each first cooling passageway 42A intersects with a plurality of second cooling passageways 42B and each second cooling passageway 42B intersects with a plurality of first cooling passageways 42A. Thus, the cooling fluid $C_F$ flowing through each cooling passageway 42 interacts with cooling fluid $C_F$ flowing through other ones of the cooling passageways 42, causing turbulent air flows and pressure drops in the cooling passageways 42. The turbulent air flows are believed to increase convective heat transfer from the wall structure section 22 to the cooling fluid $C_F$, thus improving cooling of the conduit 10. Further, the diamond shaped nodes 44 and the radially inner and outer surface sections 45A and 45B defining the mesh arrangement of the first and second cooling passageways 42A and 42B create a large amount of cooling surface area within the region 28, resulting in improved cooling of the conduit 10.

The pressure drops within the cooling passageways 42 are believed to reduce cooling fluid "blow off" out of the exit passages 36. That is, by reducing the pressure of the cooling fluid $C_F$ within the cooling passageways 42, the pressure of the cooling fluid $C_F$ exiting the exit passages 36 is reduced. Thus, the velocity and momentum of the cooling fluid $C_F$ exiting the exit passages 36 and entering the inner volume 20 of the conduit 10 are reduced, such that the cooling fluid $C_F$ is more likely to flow along the inner surface 16 of the wall structure 14, rather than be injected radially inwardly into the hot combustion gas flow path, and, hence, provide enhanced film cooling of the inner surface 16.

Further, the pressure drops within the cooling passageways 42 are believed to allow for a greater number and/or increased exit area of the exit passages 36 provided in the outlet 26. That is, the higher pressure drop in the cooling passageways 42 will result in a lower cooling fluid flow rate and a lower pressure at the exit passages 36. The number and/or exit area of the exit passages 36 can be increased to maintain an adequate cooling fluid flow rate into the conduit 10. The increase in the number and/or exit area of the exit passages 36 improves film cooling coverage of the inner surface 16 of the wall structure 14.

During operation of the engine, the cooling fluid $C_F$ is provided to cool the conduit 10, which, if not cooled, may become overheated by the hot combustion gases $C_G$ flowing through the inner volume 20 thereof. Specifically, upon entering the inlets 24 of each section 22, the cooling fluid $C_F$ provides impingement cooling to the corresponding wall structure section 22 proximate to the annular groove 30. The cooling fluid $C_F$ flows downstream through the cooling passageways 42 where the cooling fluid $C_F$ provides convective cooling to each corresponding wall structure section 22. The interaction between the cooling fluid $C_F$ flowing through the first passageways 42A with the cooling fluid $C_F$ flowing through the second passageways 42B causes turbulent air flows and pressure drops as discussed above. The cooling fluid $C_F$ exits the cooling passageways 42 and enters the exit manifold 34 of each section 22. The cooling fluid $C_F$ then passes through the exit passages 36 and exits each corresponding section 22. Upon exiting the exit passages 36, at least a portion of the cooling fluid $C_F$ from each section 22 flows along the inner surface 16 of the wall structure 14 to provide film cooling for the inner surface 16 of the wall structure 14. It is noted that the cooling fluid $C_F$ passes toward the inner volume 20 of the conduit 10 from the outside of the conduit 10 as a result of the pressure inside the conduit 10 being less than the pressure outside of the conduit 10. This pressure differential also substantially prevents the hot combustion gases $C_G$ from entering the outlets 26 and flowing through the regions 28 toward the inlets 24.

It is noted that the conduit 10 may be cast as a single component using a ceramic core or mold that forms the inlets 24, the outlets 26, and the regions 28. Alternately, the inner and outer segments 19A and 19B may be formed individually, wherein the inlets 24, the outlets 26, and the regions 28 may be formed, e.g., machined, in respective ones or one or both of the inner and outer segments 19A and 19B. Thereafter, the inner and outer segments 19A and 19B may be joined together, such as, for example, by brazing, welding, or bolting, to complete the conduit 10. Such a resulting configuration is illustrated in FIGS. 1 and 2.

Figure 3:
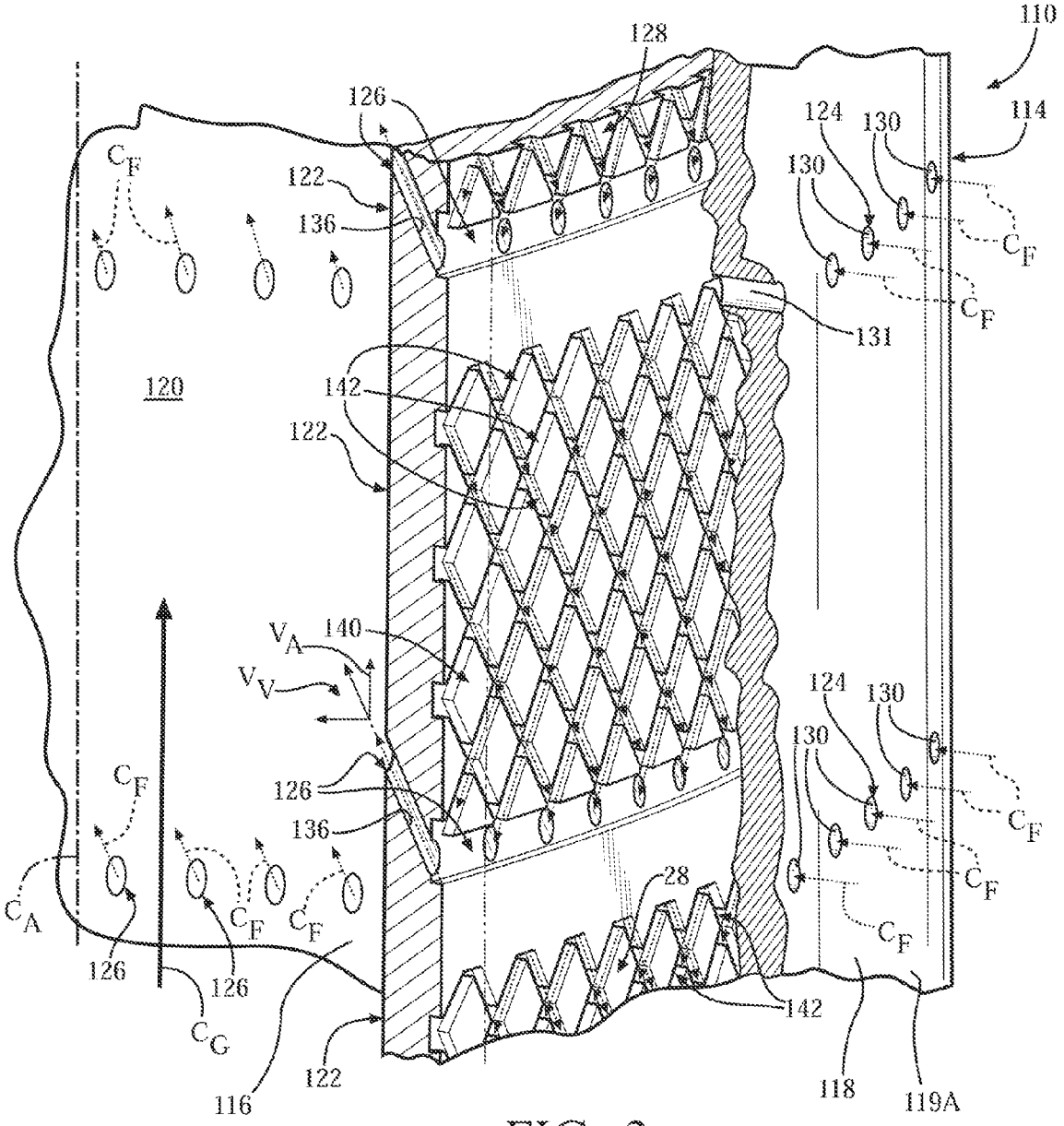
FIG. 3 is an enlarged view of a portion of a conduit according to another embodiment of the invention.

Referring to FIG. 3, a portion of a conduit 110 according to another embodiment of the invention is shown. As with the conduit 10 described above with respect to FIGS. 1 and 2, the conduit 110 according to this embodiment comprises a wall structure 114 including a plurality of sections 122, wherein each section includes a cooling fluid inlet 124, a cooling fluid outlet 126, and a region 128 extending between inner and outer surfaces 116 and 118 of the wall structure 114.

In this embodiment, the cooling fluid inlet 124 comprises a plurality of inlet openings 130 formed in the outer surface 118 of the wall structure 114. The inlet openings 130 fluidly communicate directly with cooling passages 142 of a cooling fluid structure 140 via a plurality of inlet passages 131 extending through an outer segment 119A of the wall structure 114. It is noted that the inlet passages 131 may fluidly communicate with an inlet manifold (not shown) formed in the wall structure 114, wherein the cooling passages 142 could each be in fluid communication with the inlet manifold. In the embodiment shown, the inlet 124 is axially downstream from the corresponding outlet 126 relative to a direction of a flow of hot combustion gases $C_G$ passing through the conduit 110, such that cooling fluid $C_F$ travels axially upstream through the cooling passageways 142 from the inlet 124 to the corresponding outlet 126. However, as in the embodiment described above with respect to FIGS. 1 and 2, exit passages 136 of the outlet 126 extend at an angle through the wall structure 114 such that the cooling fluid $C_F$ passing into an inner volume 120 of the conduit 110 includes an axial component $V_A$ of a velocity vector $V_V$ in the same direction as the direction of flow of the hot combustion gases $C_G$ passing through the conduit 110.

Remaining structure and its operation according to this embodiment is the same as described above with respect to FIGS. 1 and 2.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A conduit through which hot combustion gases pass in a can-annular gas turbine engine, the conduit comprising:

a wall structure having a central axis, said wall structure second instance being one of a liner and transition duct between a combustion section and a turbine section in the can-annular gas turbine, the wall structure comprising:

an inner surface defining an inner volume of the conduit;

an outer boundary defining an outermost surface of the conduit;

a region extending between said inner and outermost surfaces, said region comprising cooling fluid structure defining a plurality of cooling passageways;

an inlet extending inwardly from said outermost surface to said passageways to allow cooling fluid to pass through said inlet and enter said passageways, wherein said inlet includes a circumferential groove extending about substantially an entire circumference of said outermost surface and extending radially inwardly continuously through said outermost surface to said region, said circumferential groove extending in a direction oriented transverse to said central axis for receiving said cooling fluid in the direction oriented transverse to said central axis; and an outlet extending from said passageways to said inner surface to allow cooling fluid to exit said passageways and enter said inner volume; and wherein at least one first cooling passageway intersects with at least one second cooling passageway such that cooling fluid flowing through said first cooling passageway interacts with cooling fluid flowing through said second cooling passageway, and wherein said cooling fluid flows through said cooling passageways having a component of the flow in a direction parallel to said central axis.

2. The conduit according to claim 1, wherein said outlet comprises at least one exit passage formed in said wall structure and extending at an angle such that the cooling fluid passing into the inner volume of the conduit through said at least one exit passage includes an axial component of a velocity vector in the same direction as the direction of flow of the hot combustion gases passing through the conduit.

3. The conduit according to claim 2, wherein said outlet further comprises an exit manifold formed in said wall structure and in communication with said passageways in said region and said at least one exit passage.

4. The conduit according to claim 1, wherein said cooling fluid structure defines a mesh arrangement of cooling passageways, wherein each of two or more of said cooling passageways intersects with a plurality of other ones of said cooling passageways such that the cooling fluid flowing through each of said two or more cooling passageways interacts with cooling fluid flowing through said other ones of said cooling passageways, causing turbulent air flows and pressure drops in said passageways.

5. The conduit according to claim 1, wherein said inlet is located axially upstream from said outlet such that the cooling fluid flowing through said cooling passageways flows axially downstream from said inlet to said outlet.

6. The conduit according to claim 1, wherein said circumferential groove is in fluid communication with at least two of said cooling passageways defined by said cooling fluid structure.

7. The conduit according to claim 1, wherein said plurality of cooling passageways are defined by a plurality of diamond-shaped nodes.

8. The conduit according to claim 1, wherein said outlet comprises an annular manifold formed in said wall structure, said annular manifold in fluid communication with each of said cooling passageways defined by said cooling fluid structure.

9. The conduit according to claim 8, wherein said outlet further comprises a plurality of passages formed in said wall structure, each said passage in fluid communication with said annular manifold.

10. A conduit through which hot combustion gases pass in a can-annular gas turbine engine, the conduit comprising:

a wall structure having a central axis, said wall structure second instance being one of a liner and transition duct between a combustion section and a turbine section in the can-annular gas turbine, the wall structure comprising:

an inner surface defining an inner volume of the conduit;

an outer boundary defining an outermost surface of the conduit;

a region extending between said inner and outermost surfaces, said region comprising cooling fluid structure defining a plurality of cooling passageways;

an inlet extending inwardly from said outermost surface to said passageways to allow cooling fluid to pass through said inlet and enter said passageways, wherein said inlet includes a circumferential groove extending about substantially an entire circumference of said outermost surface and extending radially inwardly continuously through said outermost surface to said region, said circumferential groove extending in a direction oriented transverse to said central axis for receiving said cooling fluid in the direction oriented transverse to said central axis; and an outlet extending from said passageways to said inner surface to allow cooling fluid to exit said passageways and enter said inner volume; and wherein said cooling fluid structure defines a mesh arrangement of cooling passageways, wherein each of two or more of said cooling passageways intersects with a plurality of other ones of said cooling passageways such that the cooling fluid flowing through each of said two or more cooling passageways interacts with cooling fluid flowing through said other ones of said cooling passageways, and wherein said cooling fluid flows through said cooling passageways having a component of the flow in a direction parallel to said central axis.

11. The conduit according to claim 10, wherein said outlet comprises at least one exit passage formed in said wall structure and extending at an angle such that the cooling fluid passing into the inner volume of the conduit through said at least one exit passage includes an axial component of a velocity vector in the same direction as the direction of flow of the hot combustion gases passing through the conduit.

12. The conduit according to claim 11, wherein said outlet further comprises an exit manifold formed in said wall structure and in communication with said passageways in said region and said at least one exit passage.

13. The conduit according to claim 10, wherein said circumferential groove is in fluid communication with each of said cooling passageways defined by said cooling fluid structure.

14. The conduit according to claim 10, wherein said plurality of cooling passageways are defined by a plurality of diamond-shaped nodes.

15. A conduit through which hot combustion gases pass in a can-annular gas turbine engine, the conduit comprising:

a wall structure having a central axis, said wall structure second instance being one of a liner and transition duct between a combustion section and a turbine section in the can-annular gas turbine, the wall structure comprising:

an inner surface defining an inner volume of the conduit;

an outer boundary defining an outermost surface of the conduit;

a region extending between said inner and outermost surfaces, said region comprising cooling fluid structure defining a plurality of cooling passageways;

an inlet extending inwardly from said outermost surface to said passageways to allow cooling fluid to pass through said inlet and enter said passageways, wherein said inlet includes a circumferential groove extending about substantially an entire circumference of said outermost surface and extending radially inwardly continuously through said outermost surface to said region, said circumferential groove extending in a direction oriented transverse to said central axis for receiving said cooling fluid in the direction oriented transverse to said central axis; and an outlet extending from said passageways to said inner surface to allow cooling fluid to exit said passageways and enter said inner volume, said outlet comprising:

an exit manifold formed in said wall structure in communication with said passageways in said region; and a plurality of passages formed in said wall structure, each said passage in fluid communication with said exit manifold; and wherein at least one first cooling passageway intersects with at least one second cooling passageway such that cooling fluid flowing through said first cooling passageway interacts with cooling fluid flowing through said second cooling passageway, and wherein said cooling fluid flows through said cooling passageways having a component of the flow in a direction parallel to said central axis.

16. The conduit according to claim 15, wherein said passages of said outlet extend at an angle such that the cooling fluid passing into the inner volume of the conduit through said outlet passages includes an axial component of a velocity vector in the same direction as the direction of flow of the hot combustion gases passing through the conduit.

17. The conduit according to claim 15, wherein said cooling fluid structure comprises a plurality of diamond-shaped nodes and defines a mesh arrangement of first and second cooling passageways, wherein each first cooling passageway intersects with a plurality of said second cooling passageways such that the cooling fluid flowing through each said first cooling passageway interacts with cooling fluid flowing through said plurality of said second cooling passageways, causing turbulent air flows and pressure drops in said passageways.

18. The conduit according to claim 15, wherein said circumferential groove is in fluid communication with each of said cooling passageways defined by said cooling fluid structure.

19. The conduit according to claim 15, wherein the conduit is located between a combustion section and a turbine section in the gas turbine engine.

* * * * *